United States Patent [19]

Tzeng

[11] Patent Number: 4,973,891

[45] Date of Patent: Nov. 27, 1990

[54] ARTIFICIAL FLOWER DRIVING MECHANISM

[76] Inventor: Hai Tzeng, No. 9, Alley 39, Lane 164, Kan-lo Street, Neihu, Taipei, Taiwan

[21] Appl. No.: 504,257

[22] Filed: Apr. 4, 1990

[51] Int. Cl.[5] ..... A63H 13/00; A41G 1/00

[52] U.S. Cl. ..... 318/15; 446/358; 428/12; 428/24

[58] Field of Search ..... 318/15; 428/12, 24, 428/25, 26; 446/236, 281, 282, 284, 288, 352, 353, 354, 358, 474, 484

[56] References Cited

U.S. PATENT DOCUMENTS

| | | | |
|---|---|---|---|
| 4,676,764 | 6/1987 | Yeu | 446/358 X |
| 4,738,881 | 4/1988 | Lee | 428/12 |
| 4,810,227 | 3/1989 | Kim | 446/358 X |

*Primary Examiner*—Bentsu Ro

*Attorney, Agent, or Firm*—Bucknam and Archer

[57] ABSTRACT

Artificial flower driving mechanism to drive the flowering twig of an artificial flower to twist and the petals of such an artificial flower to simultaneously close and open. A base board is connected with an upper board defining therebetween an enclosure for the mounting therein of a motor and a gear mechanism. A mounting plate is secured to the bottom side of the board for the mounting thereon of a toothed wheel and a pinion, wherein the toothed wheel and the pinion are engaged together and driven to rotate by the gear driving mechanism. During operation the motor drives the gear driving mechanism to carry a flexible tube to twist and simultaneously drive the toothed wheel to rotate permitting a T-post thereon to carry a rigid cord to move up and down so as to simultaneously drive artificial petals to close and open on a petal holder.

2 Claims, 3 Drawing Sheets

ARTIFICIAL FLOWER DRIVING MECHANISM

BACKGROUND OF THE INVENTION

The present invention is related to driving mechanisms and more particularly to such a driving mechanism which drives the artificial flowering twig of an artificial flower to twist and simultaneously drive the artificial petals of such an artificial flower to close and open.

Artificial flowers have been commonly used for indoor decoration. Regular artificial flows, such as dehydrated flowers which are made of genuine flowers through dehydration process and other synthetic flowers made of plastic materials or satin ribbons etc., are generally of fixed type, which may present a sense of beauty but give no vitality.

Recently, there are some ones who incorporated artificial flowers with a transmission motor and ring bells permitting the flowers to rotate and produce ringing sound. This arrangement gives an artificial flower a new life but not attractive enough. It is therefore, an object of the present invention to provide such an artificial flower driving mechanism which drives the artificial flowering twig of an artificial flower to twist and simultaneously drive the artificial petals of such an artificial flower to close and open, permitting the motion of the artificial flower simulates a living plant.

BRIEF DESCRIPTION OF THE DRAWINGS

Embodiments of the present invention will now be described by way of example with referenced to the annexed drawings, in which.

DETAILED DESCRIPTION OF THE PREFERRED EMBODIMENTS

Figure 1:
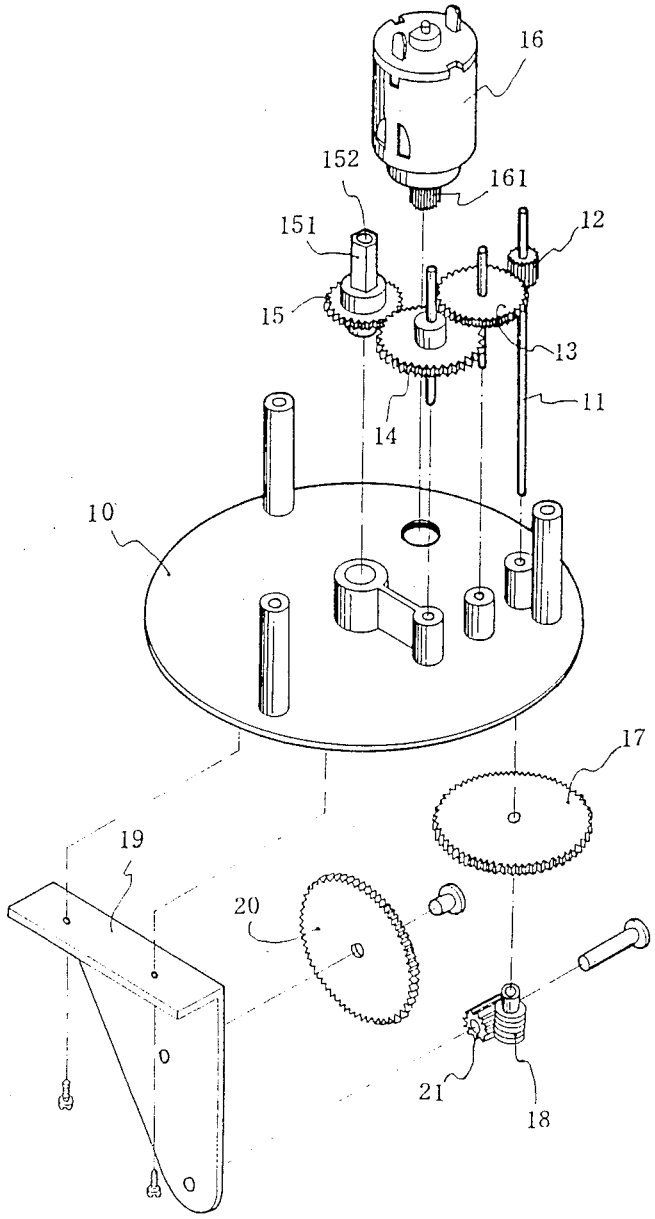
FIG. 1 is a perspective fragmentary view of an artificial flower driving mechanism according to the present invention.

Turning now to the annexed drawings in greater detail and referring first to FIg. 1, therein illustrated is a driving mechanism in accordance with the present invention. As illustrated, there are pillar supports upstanding from a base board 10 of mounting one set of gear driving mechanism which comprises a main driving shaft 11 having thereon a first pinion 12 engaged with a first gear wheel 13 which has a toothed circular projection 131 (FIG. 3) engaged with a second gear wheel 14 to drive a drive gear 15 to rotate. The drive gear 15 has a polygonal central shaft 151 upstanding therefrom and a center hole 152 through the central axis of its centrals haft 151. A motor 16 which has a transmission gear 161 on its motor shaft is mounted on the base board 10. After the first pinion 12 is mounted on the upper end of the main driving shaft 11 the lower end of the main driving shaft 11 is inserted through the base board 10 for the fastening thereon of a first toothed wheel 17 and a screw rod 18. A mounting plate 19 is fixedly secured to the bottom side of the base board 10 by means of screws to provide a mounting face for the mounting thereon of a second toothed wheel 20 and a second pinion 21. The second toothed wheel 20 is engaged with the second pinion 21 and the second pinion 21 is engaged with the screw rod 18. After the motor 16 is fastened in the base board 10, the transmission gear 161 is engaged with the first toothed wheel 17 to drive the main driving shaft to rotate.

Figure 2:
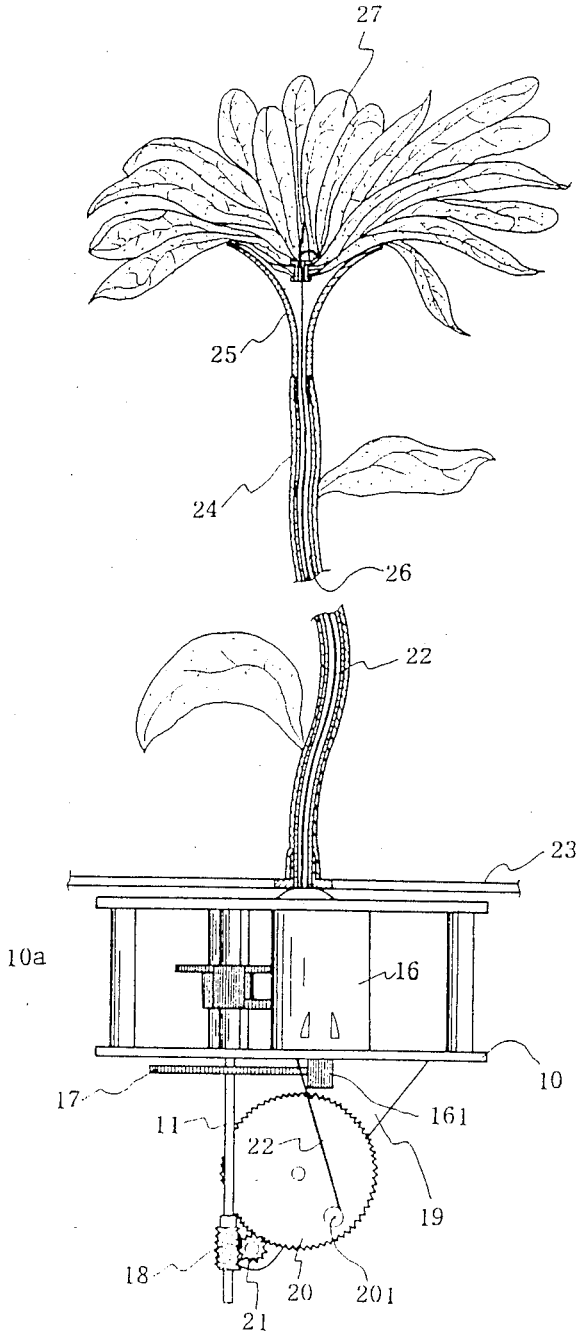
FIG. 2 is a sectional elevation of an artificial flower embodying the present invention.

Referring to FIG. 2, san upper board **10*a* is mounted on the base board 10 at the top to secure the motor 16 and the gear driving mechanism therein. As illustrated, the transmission gear 161 is engaged with the first toothed wheel 17 of the main driving shaft 11 so that the first toothed wheel 17 is driven to carry the main driving shaft 11 to rotate, permitting the screw rod 18 to drive the second pinion 21 to carry the second toothed wheel 20 to rotate. The second toothed wheel 20 has a T-post 201 on its circumferenced to secure a rigid cord 22. A cover board 23 is mounted on the top of the upper board 10*a* for the fastening therein of a flexible tube 24. A bugle-like petal holder 25 is fixedly mounted on the top of the flexibly tube 24. A copper tube 26 is inserted in the flexible tube 24 for guiding the rigid cord 22 to the bugle-like petal holder 25 to bind up a plurality of artificial petals 27 on the bugle-like petal holder 25. When the second toothed wheel 20 is carried to rotate, the T-post 201 follows the second toothed wheel 20 to rotate so as to carry the rigid cord 22 to move up and down inside the copper tube 26. During the reciprocating motion of the rigid cord 22, the artificial petals 27 are repeatedly carried to close and open on the bugle-like petal holder 25**.

Figure 3:
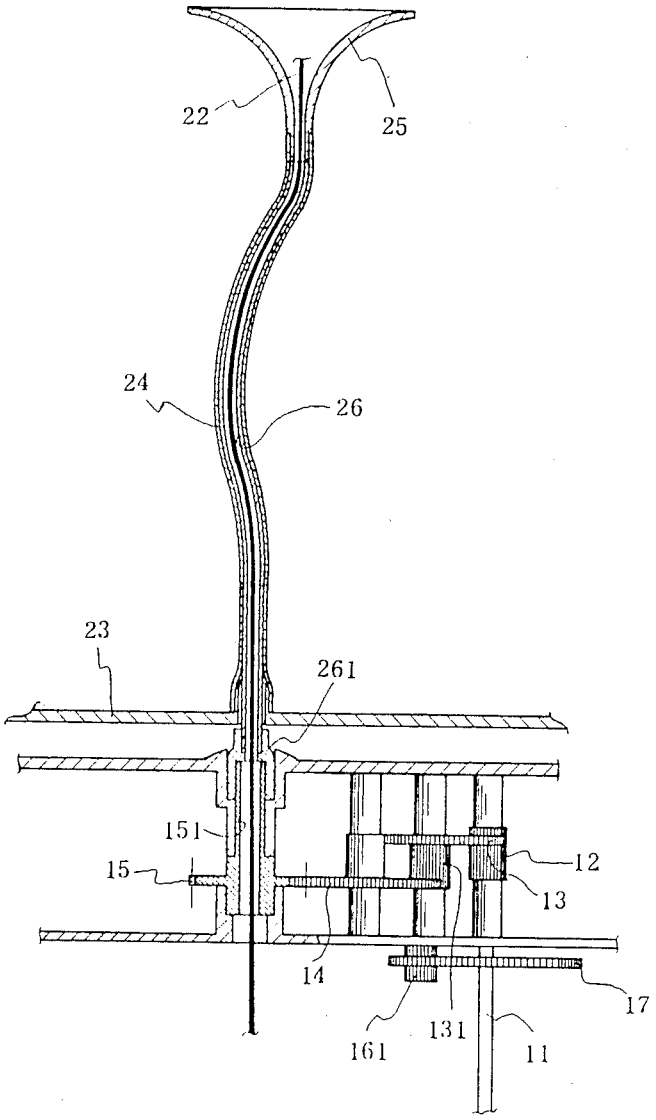
FIG. 3 is a sectional view of the artificial flower of FIG. 2, illustrating structure of the driving gear set thereof.

Referring to FIg. 3, when the transmission gear 161 of the motor 16 drives the first toothed wheel 17 to carry the main driving shaft 11 to rotate, the first pinion 12 follows the rotation of the main driving shaft 11 to carry the first gear wheel 13 to rotate, permitting the toothed circular projection 131 to drive the second gear wheel 14 to carry the drive gear 15 to rotate simultaneously. The copper tube 26 which is received in the flexible tube 24 is fixedly connected with a cap 261 on its bottom end, which cap 261 has a polygonal inner hole 261 into which the polygonal central shaft 151 of the drive gear 15 is fastened. When the drive gear 15 is carried to rotate, the polygonal central shaft 151 drive the copper tube 26 to rotate simultaneously. During the rotation of the irregularly curved copper tube 26, the flexible tube 24 is carried to twist irregularly on the cover board 23 just like the motion of the stalk of a plant which is formed to oscillate by wind force. When the flexible tube 24 is driven by the copper tube 26 to twist, the rigid cord 22 inside the copper tube 24 is simultaneously carried by the second toothed wheel 20 to drive the artificial petals 27 to close and open. The whole motion of the mechanism simulates a living plant.

Electronic components may be used to turn on/off the power supply for the motor 16 by means of acoustic control permitting structure of the present invention to start or stop moving according to the initiation or termination of a music. The artificial petals 27 may be variously embodied to form a flower of the chrysanthemum, the rose or the others.

As indicated, the present invention may be variously embodied. Recognizing that various modifications been apparent the scope herein shall be deemed as defined in the claims set forth hereinafter.

I claim:

1. An artificial flower driving mechanism, comprising a base board connected with an upper board defining therebetween an enclosure for the mounting therein of a gear driving mechanism, said gear driving mechanism comprising:

a main driving shaft inserted through said base board and having a firs pinion on its upper end and a first toothed wheel nd a screw rod on its lower end;

a first gear wheel engaged with said firs pinion and having a toothed circular projection on its lower end;

a second gear wheel engaged with said toothed circular projection of said first gear wheel;

a drive gear engaged with said second gear wheel and having a polygonal central shaft upstanding therefrom and a center hole through the central axis of its central shaft;

a mounting plate fixedly secured to the bottom side of said base board to provide a mounting face for the mounting thereon of a second toothed wheel and a second pinion, said second toothed wheel being engaged with said second pinion at one end and said second pinion being engaged with said screw rod at an opposite end, said second toothed wheel having a T-post on its circumference;

a motor having a motor shaft coupled with a transmission gear engaged with said first toothed wheel of said main driving shaft;

a flexible tube extending upward from a cover board on the top of said upper board to coupled with a bugle-like petal holder on its top end;

an irregularly curved copper tube inserted in said flexible tube with its bottom end fixedly connected with a cap, said cap having a polygonal inner hole for the fastening therein of said polygonal central shaft of said drive gear;

a rigid cord inserted through said copper tube with its bottom end fixedly secured to said T-post of said second toothed wheel and with its top end extending to said bugle-like petal holder to retain a plurality of artificial petals on said bugle-like petal holder;

characterized in that said motor drives said drive gear to carry said flexible tube to twist and simultaneously drive said second toothed wheel to rotate permitting said T-post to carry said rigid cord to move up and down so as to simultaneously drive said artificial petals to close and open on said petal holder.

2. An artificial flower driving mechanism as claimed in claim 1, wherein said artificial petals can be designed to from a flower of the chrysanthemum, the rose or the others.

* * * * *